US011512561B2

(12) United States Patent
Fripp et al.

(10) Patent No.: US 11,512,561 B2
(45) Date of Patent: Nov. 29, 2022

(54) EXPANDING METAL SEALANT FOR USE WITH MULTILATERAL COMPLETION SYSTEMS

(71) Applicant: Halliburton Energy Services, Inc., Houston, TX (US)

(72) Inventors: Michael Linley Fripp, Carrollton, TX (US); Mark C. Glaser, Houston, TX (US); Stephen Michael Greci, Little Elm, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 139 days.

(21) Appl. No.: 16/612,693

(22) PCT Filed: Feb. 22, 2019

(86) PCT No.: PCT/US2019/019210

§ 371 (c)(1),
(2) Date: Nov. 11, 2019

(87) PCT Pub. No.: WO2020/171825

PCT Pub. Date: Aug. 27, 2020

(65) Prior Publication Data

US 2021/0332673 A1 Oct. 28, 2021

(51) Int. Cl.

| | |
|---|---|
| ***E21B 41/00*** | (2006.01) |
| ***E21B 17/08*** | (2006.01) |
| ***E21B 33/12*** | (2006.01) |

(52) U.S. Cl.

CPC ..... *E21B 41/0042* (2013.01); *E21B 17/08* (2013.01); *E21B 33/1212* (2013.01); *E21B 41/0035* (2013.01)

(58) Field of Classification Search

CPC ..... E21B 41/0042; E21B 33/1212; E21B 33/1208; E21B 17/08; E21B 41/0035

See application file for complete search history.

(56) References Cited

U.S. PATENT DOCUMENTS

| | | | |
|---|---|---|---|
| 1,982,569 | A | 11/1934 | Byrd |
| 3,046,601 | A | 7/1962 | Hubbert et al. |

(Continued)

FOREIGN PATENT DOCUMENTS

| | | | |
|---|---|---|---|
| CA | 2751473 | A1 | 8/2010 |
| CA | 2751473 | C | 9/2014 |

(Continued)

OTHER PUBLICATIONS

International Search Report and Written Opinion dated Nov. 22, 2019; International PCT Application No. PCT/US2019/019210.

(Continued)

*Primary Examiner* — Nicole Coy
(74) *Attorney, Agent, or Firm* — McGuireWoods LLP

(57) ABSTRACT

A junction for use in a multilateral completion system is presented. The junction comprises a metal sealant applicable to a lateral component of the multilateral completion system. The metal sealant is expanding in response to hydrolysis and after activation forms a seal and an anchor with a well casing or tubing of the multilateral completion system. The metal sealant is expanding in response to one of an alkaline earth metal hydrolysis and a transition metal hydrolysis. More specifically, the metal sealant is expanding in response to one of magnesium hydrolysis, aluminum hydrolysis, calcium hydrolysis, and calcium oxide hydrolysis.

20 Claims, 3 Drawing Sheets

(56) References Cited

U.S. PATENT DOCUMENTS 3,385,367 A 5/1968 Kollsman
4,445,694 A 5/1984 Flaherty
4,612,985 A 9/1986 Rubbo et al.
4,846,278 A 7/1989 Robbins
5,139,235 A 8/1992 Kilmer
5,163,321 A 11/1992 Perales
5,803,177 A 9/1998 Hriscu et al.
6,098,717 A 8/2000 Bailey et al.
6,321,861 B1 11/2001 Leichter
6,367,845 B1 4/2002 Otten et al.
6,640,893 B1 11/2003 Rummel et al.
6,695,061 B2 2/2004 Fripp et al.
7,007,910 B1 3/2006 Krinner et al.
7,040,404 B2 5/2006 Brothers et al.
7,387,158 B2 6/2008 Murray et al.
7,431,082 B2 10/2008 Holt et al.
7,543,639 B2 6/2009 Emerson
7,562,704 B2 7/2009 Wood et al.
7,578,347 B2 8/2009 Bosma et al.
7,591,319 B2 9/2009 Xu
7,909,110 B2 3/2011 Sharma et al.
7,931,079 B2 4/2011 Nicholson
7,984,762 B2 * 7/2011 Renshaw ..... E21B 41/0042 166/313
8,083,000 B2 12/2011 Nutley et al.
8,235,075 B2 8/2012 Saltel
8,240,377 B2 8/2012 Kulakofsky et al.
8,434,571 B2 5/2013 Kannan et al.
8,443,881 B2 5/2013 Thomson et al.
8,490,707 B2 * 7/2013 Robisson ..... E21B 33/1208 166/387
8,499,843 B2 8/2013 Patel et al.
8,776,899 B2 7/2014 Fripp et al.
9,033,046 B2 5/2015 Andrew et al.
9,091,133 B2 7/2015 Stewart et al.
9,133,683 B2 9/2015 Dyer et al.
9,404,030 B2 8/2016 Mazyar et al.
9,518,453 B2 12/2016 Dilber et al.
9,605,508 B2 3/2017 Xu et al.
9,624,752 B2 4/2017 Resink
9,725,979 B2 8/2017 Mazyar et al.
9,745,451 B2 8/2017 Zhao et al.
9,856,710 B2 1/2018 Zhu et al.
9,869,152 B2 1/2018 Gamstedt et al.
9,976,380 B2 5/2018 Davis et al.
10,119,011 B2 11/2018 Zhao et al.
10,364,636 B2 7/2019 Davis et al.
10,428,624 B2 * 10/2019 Vasques ..... E21B 41/0042
10,704,362 B2 7/2020 Themig et al.
10,851,615 B2 12/2020 Watson et al.
10,961,804 B1 3/2021 Fripp et al.
2002/0125008 A1 9/2002 Wetzel et al.
2003/0150614 A1 8/2003 Brown et al.
2004/0118572 A1 6/2004 Whanger et al.
2004/0149418 A1 8/2004 Bosma et al.
2004/0244994 A1 12/2004 Jackson
2005/0039927 A1 2/2005 Wetzel et al.
2005/0092485 A1 5/2005 Brezinski
2005/0171248 A1 8/2005 Li et al.
2005/0199401 A1 9/2005 Patel et al.
2005/0257961 A1 11/2005 Snell et al.
2006/0175065 A1 8/2006 Ross
2007/0089911 A1 4/2007 Moyes
2007/0095532 A1 5/2007 Head et al.
2007/0125532 A1 6/2007 Murray et al.
2007/0200299 A1 8/2007 Kunz
2007/0257405 A1 11/2007 Freyer
2008/0066931 A1 3/2008 Xu
2008/0142214 A1 6/2008 Keller
2008/0149351 A1 6/2008 Marya et al.
2008/0185150 A1 8/2008 Brown
2008/0185158 A1 8/2008 Chalker et al.
2008/0220991 A1 9/2008 Slay et al.
2009/0020286 A1 1/2009 Johnson
2009/0120640 A1 5/2009 Kulakofsky et al.
2009/0130938 A1 5/2009 Xu et al.
2009/0173505 A1 7/2009 Patel et al.
2009/0179383 A1 7/2009 Koloy et al.
2009/0188569 A1 7/2009 Saltel
2009/0242189 A1 10/2009 Vaidya et al.
2009/0242214 A1 10/2009 Foster et al.
2009/0272546 A1 11/2009 Nutley et al.
2009/0277651 A1 11/2009 Kilgore
2009/0277652 A1 11/2009 Nutley et al.
2010/0038074 A1 2/2010 Patel
2010/0163252 A1 7/2010 Regnault De La Mothe et al.
2010/0212891 A1 8/2010 Stewart et al.
2010/0270031 A1 10/2010 Patel
2010/0307770 A1 * 12/2010 Sponchia ..... E21B 41/0035 166/387
2011/0073310 A1 3/2011 Clemens
2011/0098202 A1 4/2011 James et al.
2011/0226374 A1 9/2011 Kalman
2011/0252879 A1 10/2011 Madhavan et al.
2011/0253393 A1 10/2011 Vaidya et al.
2012/0006530 A1 1/2012 Crabb et al.
2012/0055667 A1 3/2012 Ingram et al.
2012/0073834 A1 3/2012 Lembcke
2012/0132427 A1 5/2012 Renshaw et al.
2012/0175134 A1 7/2012 Robisson et al.
2012/0205092 A1 8/2012 Givens et al.
2012/0272546 A1 11/2012 Tsai
2012/0292013 A1 11/2012 Munshi et al.
2012/0292023 A1 11/2012 Hinkie et al.
2013/0056196 A1 3/2013 Hench
2013/0056227 A1 3/2013 Sponchia
2013/0056228 A1 3/2013 Gruetzmann et al.
2013/0146312 A1 6/2013 Gerrard et al.
2013/0248179 A1 9/2013 Yeh et al.
2014/0051612 A1 2/2014 Mazyar et al.
2014/0054047 A1 2/2014 Zhou
2014/0060815 A1 3/2014 Wang et al.
2014/0238692 A1 8/2014 Watson
2014/0251641 A1 9/2014 Marya et al.
2014/0262351 A1 9/2014 Derby
2014/0318780 A1 10/2014 Howard
2014/0354443 A1 12/2014 Roberson et al.
2014/0361497 A1 12/2014 Porta
2015/0021044 A1 1/2015 Davis et al.
2015/0060064 A1 3/2015 Lafferty et al.
2015/0101813 A1 4/2015 Zhao et al.
2015/0199401 A1 7/2015 Polehn et al.
2015/0267501 A1 9/2015 Al-Gouhi
2015/0275644 A1 10/2015 Chen et al.
2015/0308214 A1 10/2015 Bilansky et al.
2015/0344772 A1 12/2015 Drager et al.
2015/0369027 A1 12/2015 Jones et al.
2016/0032696 A1 2/2016 Caccialupi et al.
2016/0137912 A1 5/2016 Sherman et al.
2016/0138359 A1 5/2016 Zhao et al.
2016/0145965 A1 5/2016 Zhao et al.
2016/0194933 A1 7/2016 O'Brien et al.
2016/0201425 A1 7/2016 Walton et al.
2016/0215604 A1 7/2016 Potapenko
2016/0230495 A1 8/2016 Mazyar et al.
2016/0319633 A1 11/2016 Cooper et al.
2016/0376869 A1 12/2016 Rochen et al.
2016/0376870 A1 12/2016 Roselier et al.
2017/0122062 A1 5/2017 Freyer
2017/0191343 A1 7/2017 Solhaug
2017/0335673 A1 11/2017 Burke et al.
2018/0078998 A1 * 3/2018 Sherman ..... B22D 27/11
2018/0085154 A1 3/2018 Kulper et al.
2018/0087346 A1 3/2018 Rochen
2018/0087350 A1 3/2018 Sherman
2018/0266215 A1 9/2018 Fagley, IV et al.
2018/0355691 A1 12/2018 Andersen
2018/0355693 A1 12/2018 Al-AbdulJabbar et al.
2019/0017285 A1 1/2019 Kain
2019/0055808 A1 2/2019 Krueger
2019/0055839 A1 2/2019 Skillingstad et al.
2019/0128074 A1 5/2019 Stokes et al.
2019/0153852 A1 5/2019 Lallemand et al.
2019/0203101 A1 7/2019 Dusterhoft et al.

(56) References Cited

U.S. PATENT DOCUMENTS

| | | | |
|---|---|---|---|
| 2019/0249509 | A1 | 8/2019 | Jakkula et al. |
| 2019/0360297 | A1 | 11/2019 | Heiman et al. |
| 2020/0240235 | A1 | 7/2020 | Fripp et al. |
| 2020/0325749 | A1 | 10/2020 | Fripp et al. |
| 2020/0370391 | A1 | 11/2020 | Fripp et al. |
| 2021/0017441 | A1 | 1/2021 | Fripp et al. |
| 2021/0079756 | A1 | 3/2021 | Ornelaz et al. |
| 2021/0140255 | A1 | 5/2021 | Greci et al. |
| 2021/0189817 | A1 | 6/2021 | Fripp et al. |
| 2021/0332659 | A1 | 10/2021 | Fripp et al. |
| 2021/0353037 | A1 | 11/2021 | Cote |
| 2022/0074221 | A1 | 3/2022 | Laimbeer et al. |

FOREIGN PATENT DOCUMENTS

| | | | | |
|---|---|---|---|---|
| CA | 3085547 | A1 | 8/2019 | |
| CN | 1708631 | A | 12/2005 | |
| CN | 102027189 | A | 4/2011 | |
| CN | 104583530 | A | 4/2015 | |
| CN | 105422146 | A | 3/2016 | |
| CN | 106522923 | A | 3/2017 | |
| CN | 107148444 | A | 9/2017 | |
| CN | 107250321 | A | 10/2017 | |
| CN | 107532466 | A | 1/2018 | |
| EP | 2399000 | A2 | 12/2011 | |
| EP | 2217790 | B1 | 10/2016 | |
| EP | 2753791 | B1 | 6/2017 | |
| FR | 3073549 | A1 | 5/2019 | |
| GB | 2381278 | A | 4/2003 | |
| GB | 2416796 | A | 2/2006 | |
| GB | 2469723 | A | 10/2010 | |
| GB | 2514195 | B | 6/2019 | |
| GB | 2583232 | A | 10/2020 | |
| GB | 2557397 | B | 8/2021 | |
| MX | 2011008597 | A | 9/2011 | |
| RU | 2424419 | C1 | 7/2011 | |
| RU | 2588501 | C2 | 6/2016 | |
| RU | 182236 | U1 | 8/2018 | |
| WO | WO-0026501 | A1 * | 5/2000 | ..... E21B 41/0042 |
| WO | 2008079486 | A1 | 7/2008 | |
| WO | 2010096417 | A2 | 8/2010 | |
| WO | 2012090056 | A2 | 7/2012 | |
| WO | 2014098885 | A1 | 6/2014 | |
| WO | 2014110382 | A1 | 7/2014 | |
| WO | 2014210283 | A1 | 12/2014 | |
| WO | 2016171666 | A1 | 10/2016 | |
| WO | 2018005740 | A1 | 1/2018 | |
| WO | 2018057361 | A1 | 3/2018 | |
| WO | 2018085102 | A1 | 5/2018 | |
| WO | 2018147833 | A1 | 8/2018 | |
| WO | 2019094044 | | 5/2019 | |
| WO | WO-2019094044 | A1 * | 5/2019 | ..... E21B 34/06 |
| WO | 2019147285 | A1 | 8/2019 | |
| WO | 2019164492 | | 8/2019 | |
| WO | 2019164499 | | 8/2019 | |
| WO | 2020005252 | A1 | 1/2020 | |
| WO | 2020018110 | A1 | 1/2020 | |
| WO | 2021021203 | A1 | 2/2021 | |
| WO | 2021076141 | A1 | 4/2021 | |

OTHER PUBLICATIONS

International Search Report and Written Opinion dated Aug. 2, 2018, International PCT Application No. PCT/US2017/061307.
Search Report in FR Application No. 1859379, dated Oct. 15, 2019.
International Search Report and Written Opinion dated Nov. 19, 2018; International PCT Application No. PCT/US2018/019337.
Denmark Examination Report and Search Report dated Mar. 16, 2021, Denmark Application No. PA202070389.
International Search Report and Written Opinion dated Jul. 8, 2020, issued in related International Application No. PCT/US2019/056814.
International Search Report and Written Opinion for corresponding PCT International Application No. PCT/US2019/068497; dated Sep. 17, 2020.
International Search report and Written Opinion for corresponding International Patent Application No. PCT/US2019/062225, dated Aug. 11, 2020.
International Search report and Written Opinion issued in related PCT/US2019/068493 dated Sep. 15, 2020.
Nemisis Annulus Swellable Packer, Weatherford, Swellable Products, 2009-2011.
International Search Report and Witten Opinion dated May 20, 2020, issued in related PCT/US2019/047529.
Tao, Solid expandable tubular patching technique for high-temperature and high-pressure casing damaged wells, Research Paper, Jun. 2015, pp. 408-409, Petroleum Exploration and Development, vol. 42, Issue 3.
Dutch Search Report issued in NL 2026726, dated Aug. 13, 2021.
International Search Report and Written Opinion dated Sep. 8, 2021 in PCT/US2020/066193.
Search Report and Written Opinion issued in NL2026329, dated Aug. 13, 2021.
Written Opinion and Search Report in SG Appln No. 11202000316S, dated Aug. 30, 2021.
Dutch Search Report in NL Appln No. 2026737, dated Aug. 13, 2021.
Examination Report in GCC Appln No. GC 2020-39914, dated Jul. 29, 2021.
Office Action in CA Appln No. 3,070,929, dated Jul. 9, 2021.
International Search Report & Written Opinion in PCT/US2019/042074 dated Apr. 10, 2020.
Search Report in NL Appln No. 2025837, dated Sep. 23, 2021.
Office Action in CA Application No. 3,070,929 dated Nov. 19, 2021.
International Search Report & Written Opinion in PCT/US2019/017538, dated Nov. 11, 2019.
Chinese Search Report dated Dec. 17, 2021; CN Application No. 2018800875885.
Examination Report in GB Appln No. 2010931.0 dated Jan. 18, 2022.
International Search Report & Written Opinion in PCT/US2020/065539, dated Aug. 30, 2021.
International Search Report & Written Opinion in PCT/US2019/058904, dated Jul. 23, 2020.
Netherlands Search Report in Application No. 2025954, dated Mar. 2, 2021.
International Search Report and Written Opinion in PCT/US2019/044542, dated Apr. 28, 2020.
Examination Report in GCC Application No. GC 2020-40201, dated Aug. 31, 2021.
French Search Report issued in FR Appln No. FR2006166, dated May 30, 2022.
International Search Report & Written Opinion in PCT/US2021/048628 dated May 19, 2022.
International Search Report & Written Opinion in PCT/US2021/027245 dated Jan. 10, 2022.
International Search Report and Written Opinion in PCT/US2021/032983, dated Feb. 10, 2022.
Netherlands Search Report in Application No. 2026573 dated Aug. 20, 2021.
Russian Office Action in RU Application No. 2021121198, dated Nov. 25, 2021.
GC Examination Report in GC Application No. 2019-38908, dated Nov. 4, 2020.
GC Examination Report in GC Application No. 2020-40475, dated Nov. 25, 2021.
MY Search Report in MY Application No. PI2020003430, dated May 26, 2022.
GB Examination Report in Application No. 2010931.0 dated Apr. 5, 2022.
DK Examination Report in Application No. PA 202070389, dated Oct. 20, 2021.

* cited by examiner

EXPANDING METAL SEALANT FOR USE WITH MULTILATERAL COMPLETION SYSTEMS

BACKGROUND

The present disclosure relates, in general, to multilateral completion systems and, in particular, to junctions used therein. Multilateral completion systems are tools available in the oil and gas industry used for the development and production of hydrocarbon reservoirs in multilateral wellbores. Lateral boreholes are developed off of the single main borehole so that casing or production tubing can be positioned therein and tied together. Current methods of setting the casing or tubing require either a separate cement operation, liner hanger equipment, or expensive completion equipment to securely tie the casing and/or tubing together and isolate the lateral and main boreholes. These can be complex, time consuming, and laborious methods, which can incur a lot of additional costs.

BRIEF DESCRIPTION OF THE DRAWINGS

For a more complete understanding of the features and advantages of the present disclosure, reference is now made to the detailed description along with the accompanying figures in which corresponding numerals in the different figures refer to corresponding parts and in which.

DETAILED DESCRIPTION

While the making and using of various embodiments of the present disclosure are discussed in detail below, it should be appreciated that the present disclosure provides many applicable inventive concepts, which can be embodied in a wide variety of specific contexts. The specific embodiments discussed herein are merely illustrative and do not delimit the scope of the present disclosure. In the interest of clarity, not all features of an actual implementation may be described in the present disclosure. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would be a routine undertaking for those of ordinary skill in the art having the benefit of this disclosure.

The application disclosure details a low cost method, device, and system to create a TAML level 2, 3, 4, 5, 6 or any type of junction for multi-lateral completion systems. The device can be used to anchor/isolate casing and/or production tubing in a lateral without the need to run a separate cement job, or use any type of liner system. A metal solid solution is presented that has been tested and shown to expand its dimensions and hold significant pressure differentials after being exposed to water. As such, the expanding metal can be used to anchor and seal casing and production tubing. The expanding metal can be applied as an external tube or sleeve on the outside of the lateral tubing or casing. Once lateral tubing is in position and the metal sealant reacts with brine, the metal sealant will begin to increase in volume and form a metal hydroxide (or metal hydrate). This metal hydroxide will lock together and form a solid seal (as proven in research lab testing to over 7,000 psi differential per foot of length). After reaction is completed, a separate mill run can be used to cut the lateral tubing flush with the main bore.

Figure 1A:
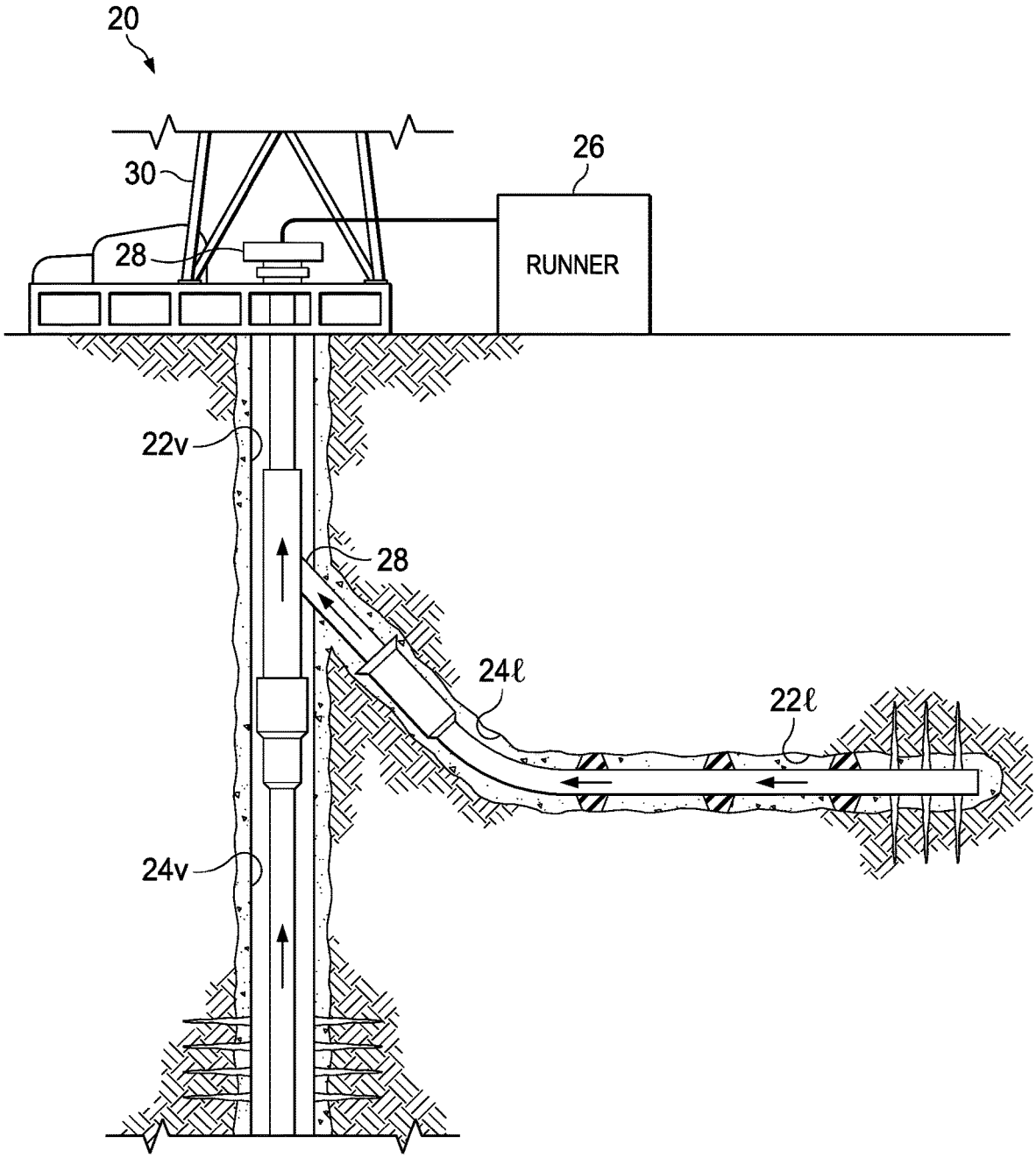
FIGS. 1A and 1B are two illustrated examples of TAML level's 5 and 6 multilateral completion systems, in accordance with certain example embodiments.
Figure 1B:
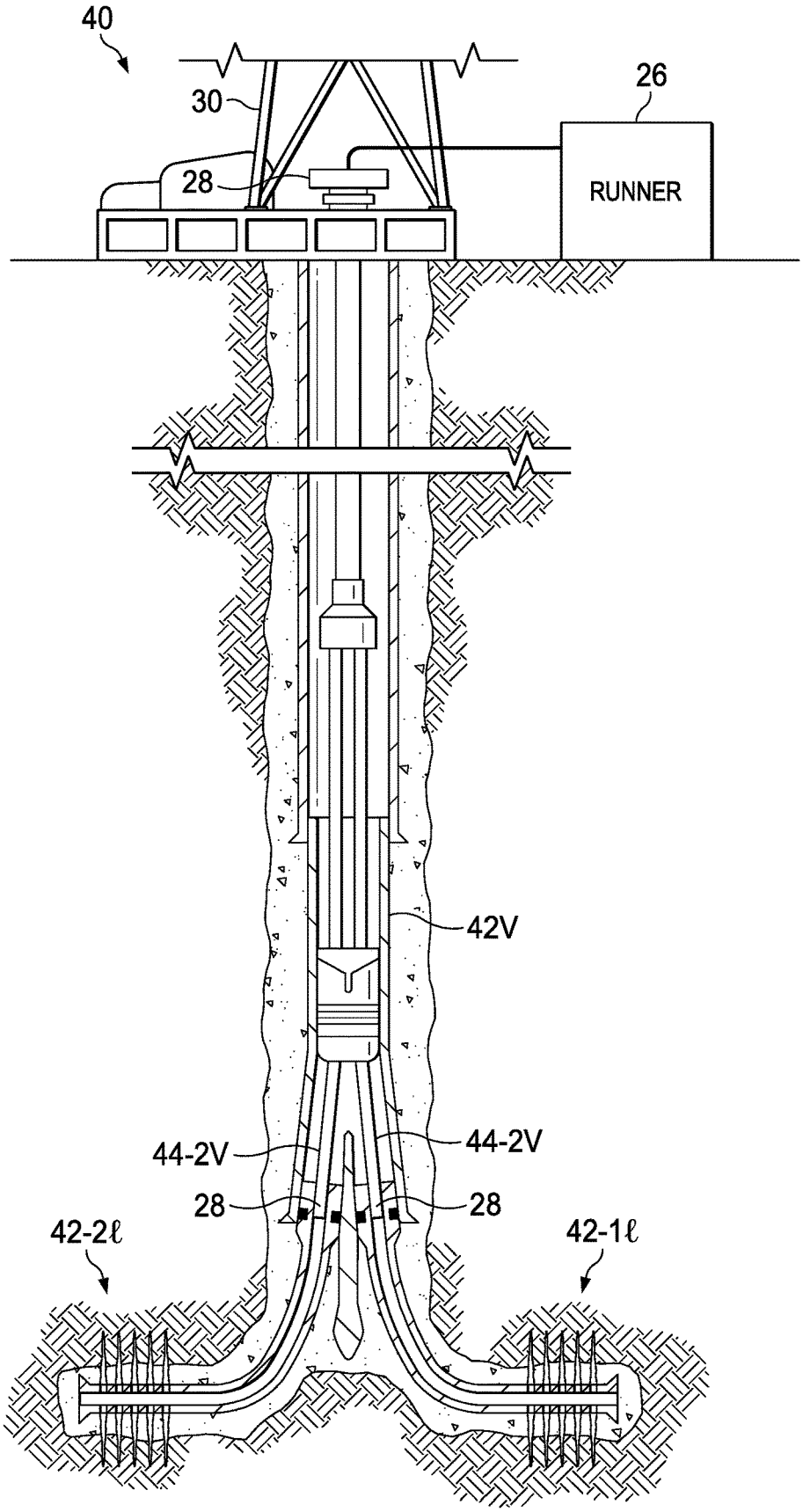

Referring now to FIGS. 1A and 1B, illustrated are two examples of level 5 and level 6 multilateral completion systems, denoted generally and respectively as 20 and 40, in accordance with certain example embodiments. The level 5 system 20 includes downhole vertical and lateral casing 22*v*, 22*l*, downhole vertical and lateral production tubing 24*v*, 24*l*, and surface level development and production tools. The level 6 system 40 includes downhole vertical and lateral casing 42*v*, 42-1*l*, and 42-2*l*, downhole vertical production tubing 44-1*v*, 44-2*l*, and surface level development and production tools. Both level 5 and level 6 systems are considered advanced wellbore system that offer greater structural integrity and pressure control than other, simpler designs. Due to complexity and possible limitations in production levels, the level 6 system is often considered a less viable option. Regardless, both systems are considered complex and expensive systems. However, the metal sealant presented herein and its application thereof, can significantly reduce the complexity and cost associated with level 5 and level 6 systems as well as provide the structural integrity and the pressure required for such advanced systems. It should be understood that obviously level 5 and level 6 systems are not the only systems that the metal sealant is applicable. The junction described herein can be used in many downhole applications where the use of junction technology is needed.

The level 5 system 20 and level 6 system 40 include a runner and tool system 26 for running a tools, casing, and tubing downhole through a wellhead 28. The running tool system 26 can be used to position a junction 28 during the development process. In an embodiment, the junction 28 includes an outer sleeve made of the metal sealant capable of setting the junction 28 so as to securely interface the vertical and lateral production tubing 24 or vertical production tubing 44-1 and 44-2. In either case, the metal sealant swells around the area of the junction 28 to create a seal with an interface after being exposed to water or similar fluid. Furthermore, properties of the metal sealant cause the hydrated junction 28 with expanding metal to act as an anchor. A pump station 30 is used to draw fluid through vertical and lateral perforations formed in the downhole formations after completion.

Figure 2A:
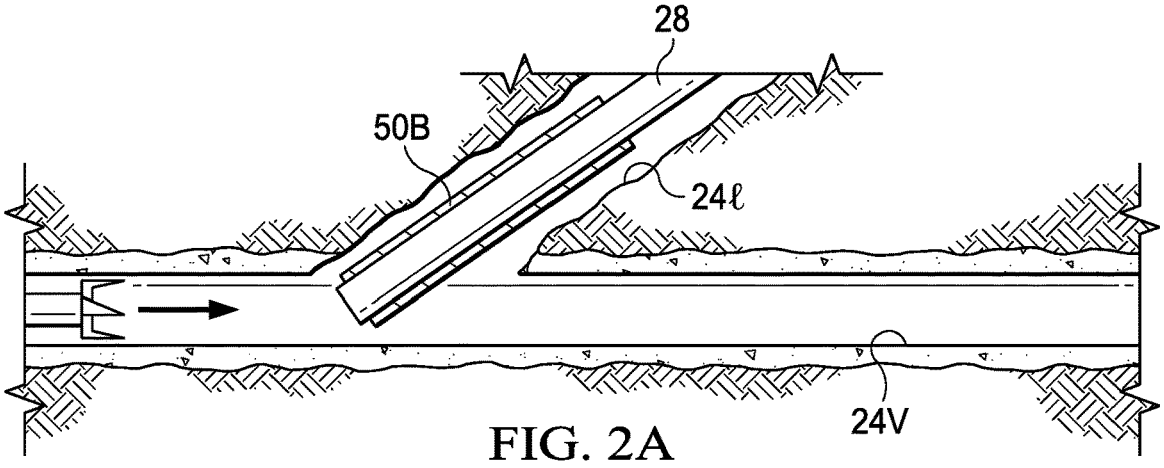
FIGS. 2A and 2B are illustrations of a junction and a metal sealant before hydration and metal sealant after hydration, in accordance with certain example embodiments.
Figure 2B:
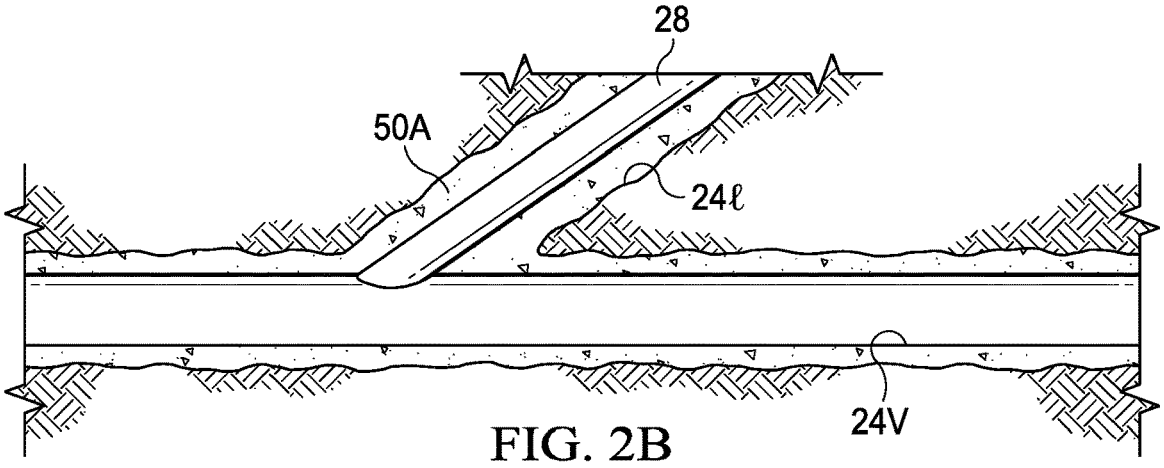

Referring now to FIGS. 2A and 2B, illustrated are junction 28 and an expanding metal sealant 50B (before hydration) and expanding metal sealant 50A (after hydration), in accordance with certain example embodiments. Alternatively, the expanding metal sealant can be described as expanding in a cement like material that seals and anchors an interface. In other words, the metal goes from metal to micron-scale particles and then these particles are compressed together to, in essence, make an anchor.

Referring now to FIGS. 2A and 2B, illustrated are junction 28 and a metal sealant 50B (before hydration) and metal sealant 50A (after hydration), in accordance with certain example embodiments. Alternatively, the metal sealant can be described as expanding in a cement like material that seals and anchors an interface. In other words, the metal goes from metal to micron-scale particles and then these particles lock together to, in essence, make an anchor. The reaction occurs in less than 30 days once in a reactive fluid and in downhole temperatures. The metal, pre-expansion, is electrically conductive. The metal can be machined to size/shape, extruded, formed, cast or other conventional ways to get the desired shape of a metal. Metal, pre-expansion, is electrically conductive. Metal, pre-expansion, has a yield strength greater than about 8,000 psi, i.e. 8,000 psi+/−50%. The metal has a minimum dimension greater than about 0.05 inches.

The hydrolysis of any metal can create a metal hydroxide. The formative properties of alkaline earth metals (Mg—Magnesium, Ca—Calcium, etc) and transition metals (Zn—Zinc, Al—Aluminum, etc) under hydrolysis reactions demonstrate structural characteristics that are favorable level 5 and level 6 multilateral completion systems. Hydration results in an increase in size from the hydration reaction and results in a metal hydroxide that can precipitate from the fluid.

The hydration reactions for magnesium is:

$$Mg+2H_2O \rightarrow Mg(OH)_2+H_2,$$

Where $Mg(OH)_2$ is also known as brucite. Another hydration reaction uses aluminum hydrolysis. The reaction forms a material known as Gibbsite, bayerite, and norstrandite, depending on form. The hydration reaction for aluminum is:

$$Al+3H_2O \rightarrow Al(OH)_3+3/2H_2.$$

Another hydration reactions uses calcium hydrolysis. The hydration reaction for calcium is:

$$Ca+2H_2O \rightarrow Ca(OH)_2+H_2,$$

Where $Ca(OH)_2$ is known as portlandite and is a common hydrolysis product of Portland cement. Magnesium hydroxide and calcium hydroxide are considered to be relatively insoluble in water. Aluminum hydroxide can be considered an amphoteric hydroxide which has solubility in strong acids or in strong bases.

In an embodiment, the metallic material used can be a metal alloy. The metal alloy can be an alloy of the base metal with other elements in order to either adjust the strength of the metal alloy, to adjust the reaction time of the metal alloy, or to adjust the strength of the resulting metal hydroxide byproduct. The metal alloy can be alloyed with elements that enhance the strength of the metal such as, but not limited to, Al—Aluminum, Zn—Zinc, Mn—Manganese, Zr—Zirconium, Y—Yttrium, Nd—Neodymium, Gd—Gadolinium, Ag—Silver, Ca—Calcium, Sn—Tin, and Re—Rhenium, Cu—Copper. In some embodiments, the alloy can be alloyed with a dopant that promotes corrosion, such as Ni—Nickel, Fe—Iron, Cu—Copper, Co—Cobalt, Ir—Iridium, Au—Gold, C—Carbon, gallium, indium, mercury, bismuth, tin, and Pd—Palladium. The metal alloy can be constructed in a solid solution process where the elements are combined with molten metal or metal alloy. Alternatively, the metal alloy could be constructed with a powder metallurgy process. The metal can be cast, forged, extruded, or a combination thereof.

Optionally, non-expanding components can be added to the starting metallic materials. For example, ceramic, elastomer, glass, or non-reacting metal components can be embedded in the expanding metal or coated on the surface of the metal. Alternatively, the starting metal may be the metal oxide. For example, calcium oxide (CaO) with water will produce calcium hydroxide in an energetic reaction. Due to the higher density of calcium oxide, this can have a 260% volumetric expansion where converting 1 mole of CaO goes from 9.5 cc to 34.4 cc of volume. In one variation, the expanding metal is formed in a serpentinite reaction, a hydration and metamorphic reaction. In one variation, the resultant material resembles a mafic material. Additional ions can be added to the reaction, including silicate, sulfate, aluminate, phosphate. The metal can be alloyed to increase the reactivity or to control the formation of oxides.

Figure 3:
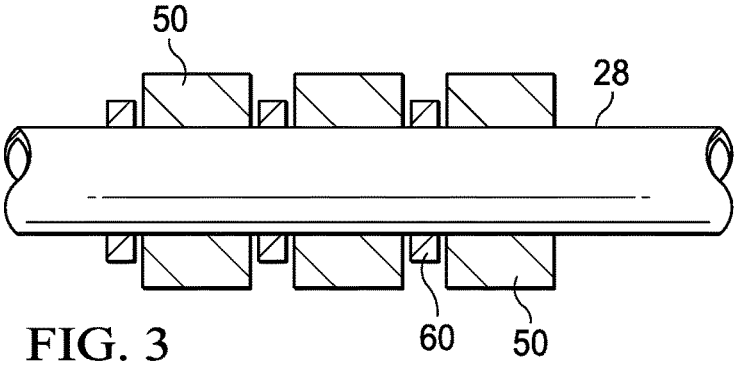
FIG. 3 is an illustration of an alternative application of a metal sealant with a lateral junction, in accordance with certain example embodiments.

Referring now to FIG. 3, illustrated is an alternative application of expanding metal sealant 50 with junction 28, in accordance with certain example embodiments. Expanding metal sealant 50 can be configured in many different fashions, as long as an adequate volume of material is available for swelling. It can be a single long tube, multiple short tubes, and/or rings. In the embodiment shown in FIG. 3, the junction 28 includes alternating metal sealant 50 and steel. The junction 28 can include multiple instances of expanding metal sealant 50 of any length and varying lengths with conventional steel rings populated thereabout to help stabilize and/or protect the expanding metal during running.

The example systems, methods, and acts described in the embodiments presented previously are illustrative, and, in alternative embodiments, certain acts can be performed in a different order, in parallel with one another, omitted entirely, and/or combined between different example embodiments, and/or certain additional acts can be performed, without departing from the scope and spirit of various embodiments. Accordingly, such alternative embodiments are included in the description herein.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure:

Clause 1, a junction for use in a multilateral completion system, the junction comprising: a metal sealant applicable to a lateral component; wherein the metal sealant is configured to expand in response to hydrolysis; wherein the lateral component and the metal sealant are configured to form a seal or to form an anchor with an oilfield tubular of the multilateral completion system in response to hydrolysis;

Clause 2 the junction of clause 1 wherein hydrolysis forms a metal hydroxide structure;

Clause 3, the junction of clause 1 wherein the metal is configured to expand in response to one of an alkaline earth metal hydrolysis and a transition metal hydrolysis;

Clause 4, the junction of clause 1 wherein the metal sealant is configured to change radial dimension in response to one of magnesium hydrolysis, aluminum hydrolysis, calcium hydrolysis, and calcium oxide hydrolysis;

Clause 5, the junction of clause 4 wherein hydrolysis forms a structure comprising one of a Brucite, Gibbsite, bayerite, and norstrandite;

Clause 6, the junction of clause 1 wherein the metal sealant is a magnesium alloy or a magnesium alloy alloyed with at least one of Al, Zn, Mn, Zr, Y, Nd, Gd, Ag, Ca, Sn, and Re;

Clause 7, the junction of clause 6 wherein the magnesium alloy is alloyed with at least one of Ni, Fe, Cu, Co, Ir, Au, and Pd;

Clause 8, a multilateral completion system comprising: a well casing or tubing; a lateral component in fluid communication with the well casing; a metal sealant applied to the lateral component; wherein the metal sealant is configured to change radial dimension in response to hydrolysis; wherein the lateral component and metal sealant are configured to form a seal or an anchor with a well casing or tubing of the multilateral completion system in response to hydrolysis;

Clause 9, the multilateral completion system of clause 8 wherein hydrolysis forms a metal hydroxide structure;

Clause 10, the multilateral completion system of clause 8 wherein the metal sealant is configured to change radial dimension in response to one of an alkaline earth metal hydrolysis and a transition metal hydrolysis;

Clause 11, the multilateral completion system of clause 8 wherein the metal sealant is configured to change radial dimension in response to one of magnesium hydrolysis, aluminum hydrolysis, calcium hydrolysis, and calcium oxide hydrolysis;

Clause 12, the multilateral completion system of clause 11 wherein hydrolysis forms a structure comprising one of a Brucite, Gibbsite, bayerite, and norstrandite;

Clause 13, the multilateral completion system of clause 8 wherein the metal sealant is a magnesium alloy or a magnesium alloy alloyed with at least one of Al, Zn, Mn, Zr, Y, Nd, Gd, Ag, Ca, Sn, and Re;

Clause 14, the multilateral completion system of clause 13 wherein the magnesium alloy is alloyed with at least one of Ni, Fe, Cu, Co, Ir, Au, and Pd;

Clause 15, a method of using a junction within a multilateral completion system, the method comprising: applying a metal sealant to a lateral component; positioning the lateral component in fluid communication with a well casing; wherein the metal sealant is configured to change radial dimension in response to hydrolysis; wherein the lateral component and metal sealant form a seal and an anchor with a well casing or tubing of the multilateral completion system in response to hydrolysis;

Clause 16, the method of clause 15 wherein hydrolysis forms a metal hydroxide structure;

Clause 17, the method of clause 15 wherein the metal sealant is configured to change radial dimension in response to one of an alkaline earth metal hydrolysis and a transition metal hydrolysis;

Clause 18, the method of clause 15 wherein the metal sealant is configured to change radial dimension in response to one of magnesium hydrolysis, aluminum hydrolysis, calcium hydrolysis, and calcium oxide hydrolysis;

Clause 19, the method of clause 18 wherein hydrolysis forms a structure comprising one of a Brucite, Gibbsite, bayerite, and norstrandite; and Clause 20, the method of clause 15 wherein the metal sealant is a magnesium alloy or a magnesium alloy alloyed with at least one of Al, Zn, Mn, Zr, Y, Nd, Gd, Ag, Ca, Sn, and Re.

The foregoing description of embodiments of the disclosure has been presented for purposes of illustration and description. It is not intended to be exhaustive or to limit the disclosure to the precise form disclosed, and modifications and variations are possible in light of the above teachings or may be acquired from practice of the disclosure. The embodiments were chosen and described in order to explain the principals of the disclosure and its practical application to enable one skilled in the art to utilize the disclosure in various embodiments and with various modifications as are suited to the particular use contemplated. Other substitutions, modifications, changes and omissions may be made in the design, operating conditions and arrangement of the embodiments without departing from the scope of the present disclosure. Such modifications and combinations of the illustrative embodiments as well as other embodiments will be apparent to persons skilled in the art upon reference to the description. It is, therefore, intended that the appended claims encompass any such modifications or embodiments.

What is claimed is:

1. A junction for use in a multilateral completion system, the junction comprising:

a metal sealant applicable to a lateral component; wherein the metal sealant consists of a material selected from the group consisting of metal, metal alloy, metal oxide, and any combination thereof;

wherein the metal sealant is configured to expand in response to hydrolysis to produce a reaction product of a metal hydroxide, metal oxide, or a combination thereof;

wherein the lateral component and the reaction product are configured to form a seal or to form an anchor with an oilfield tubular of the multilateral completion system in response to hydrolysis.

2. The junction of claim 1 wherein hydrolysis forms a metal hydroxide structure.

3. The junction of claim 1 wherein the metal is configured to expand in response to one of an alkaline earth metal hydrolysis and a transition metal hydrolysis.

4. The junction of claim 1 wherein the metal sealant is configured to change radial dimension in response to one of magnesium hydrolysis, aluminum hydrolysis, calcium hydrolysis, and calcium oxide hydrolysis.

5. The junction of claim 4 wherein hydrolysis forms a structure comprising one of a Brucite, Gibbsite, bayerite, and norstrandite.

6. The junction of claim 1 wherein the metal sealant is a magnesium alloy or a magnesium alloy alloyed with at least one of Al, Zn, Mn, Zr, Y, Nd, Gd, Ag, Ca, Sn, and Re.

7. The junction of claim 6 wherein the magnesium alloy is alloyed with at least one of Ni, Fe, Cu, Co, Ir, Au, and Pd.

8. A multilateral completion system comprising:

a well casing or tubing;

a lateral component in fluid communication with the well casing;

a metal sealant applied to the lateral component; wherein the metal sealant consists of a material selected from the group consisting of metal, metal alloy, metal oxide, and any combination thereof;

wherein the metal sealant is configured to produce a reaction product of a metal hydroxide, metal oxide, or a combination thereof thereby changing radial dimension in response to hydrolysis;

wherein the lateral component and reaction product are configured to form a seal or an anchor with a well casing or tubing of the multilateral completion system in response to hydrolysis.

9. The multilateral completion system of claim 8 wherein hydrolysis forms a metal hydroxide structure.

10. The multilateral completion system of claim 8 wherein the metal sealant is configured to change radial dimension in response to one of an alkaline earth metal hydrolysis and a transition metal hydrolysis.

11. The multilateral completion system of claim 8 wherein the metal sealant is configured to change radial dimension in response to one of magnesium hydrolysis, aluminum hydrolysis, calcium hydrolysis, and calcium oxide hydrolysis.

12. The multilateral completion system of claim 11 wherein hydrolysis forms a structure comprising one of a Brucite, Gibbsite, bayerite, and norstrandite.

13. The multilateral completion system of claim 8 wherein the metal sealant is a magnesium alloy or a magnesium alloy alloyed with at least one of Al, Zn, Mn, Zr, Y, Nd, Gd, Ag, Ca, Sn, and Re.

14. The multilateral completion system of claim 13 wherein the magnesium alloy is alloyed with at least one of Ni, Fe, Cu, Co, Ir, Au, and Pd.

15. A method of using a junction within a multilateral completion system, the method comprising:

applying a metal sealant to a lateral component; wherein the metal sealant consists of a material selected from the group consisting of metal, metal alloy, metal oxide, and any combination thereof;

positioning the lateral component in fluid communication with a well casing;

wherein the metal sealant is configured to produce a reaction product of a metal hydroxide, metal oxide, or a combination thereof thereby changing radial dimension in response to hydrolysis;

wherein the lateral component and reaction product form a seal and an anchor with a well casing or tubing of the multilateral completion system in response to hydrolysis.

16. The method of claim 15 wherein hydrolysis forms a metal hydroxide structure.

17. The method of claim 15 wherein the metal sealant is configured to change radial dimension in response to one of an alkaline earth metal hydrolysis and a transition metal hydrolysis.

18. The method of claim 15 wherein the metal sealant is configured to change radial dimension in response to one of magnesium hydrolysis, aluminum hydrolysis, calcium hydrolysis, and calcium oxide hydrolysis.

19. The method of claim 18 wherein hydrolysis forms a structure comprising one of a Brucite, Gibbsite, bayerite, and norstrandite.

20. The method of claim 15 wherein the metal sealant is a magnesium alloy or a magnesium alloy alloyed with at least one of Al, Zn, Mn, Zr, Y, Nd, Gd, Ag, Ca, Sn, and Re.

* * * * *